US010029261B2

(12) United States Patent
Motadel et al.

(10) Patent No.: US 10,029,261 B2
(45) Date of Patent: Jul. 24, 2018

(54) PIPETTE TIP RACK PLATES

(71) Applicant: BIOTIX, INC., San Diego, CA (US)

(72) Inventors: Arta Motadel, San Diego, CA (US); Peter Paul Blaszcak, San Diego, CA (US)

(73) Assignee: Biotix, Inc., San Diego, CA (US)

( * ) Notice: Subject to any disclaimer, the term of this patent is extended or adjusted under 35 U.S.C. 154(b) by 0 days.

(21) Appl. No.: 15/034,494

(22) PCT Filed: Nov. 4, 2014

(86) PCT No.: PCT/US2014/063938
§ 371 (c)(1),
(2) Date: May 4, 2016

(87) PCT Pub. No.: WO2015/069664
PCT Pub. Date: May 14, 2015

(65) Prior Publication Data

US 2016/0288126 A1 Oct. 6, 2016

Related U.S. Application Data

(60) Provisional application No. 61/900,312, filed on Nov. 5, 2013.

(51) Int. Cl.

| | |
|---|---|
| ***B01L 9/00*** | (2006.01) |
| ***B01L 3/02*** | (2006.01) |
| ***B65D 25/10*** | (2006.01) |

(52) U.S. Cl.
CPC ..... *B01L 9/543* (2013.01); *B01L 3/0275* (2013.01); *B65D 25/108* (2013.01); *B01L 2200/025* (2013.01); *B01L 2300/0829* (2013.01); *B01L 2300/0858* (2013.01)

(58) Field of Classification Search
CPC ..... B01L 3/0275; B01L 9/54; B01L 9/543
See application file for complete search history.

(56) References Cited

U.S. PATENT DOCUMENTS

| | | | | |
|---|---|---|---|---|
| 3,643,812 | A | 2/1972 | Mander et al. | |
| 6,019,225 | A | 2/2000 | Kalmakis et al. | |
| 6,286,678 | B1 | 9/2001 | Petrek | |
| 2002/0108917 | A1 | 8/2002 | Maruyama | |
| 2006/0093530 | A1 * | 5/2006 | Ueda | B01L 9/543 422/400 |
| 2006/0266719 | A1 | 11/2006 | Knight et al. | |
| 2009/0293643 | A1 | 12/2009 | Powell | |

(Continued)

FOREIGN PATENT DOCUMENTS

| | | |
|---|---|---|
| EP | 1 110 613 | 6/2001 |
| WO | WO 2011/116230 | 9/2011 |
| WO | WO 2015/069664 | 5/2014 |

OTHER PUBLICATIONS

Extended European Search Report dated Jun. 26, 2017 for European Patent Application No. 14859510.1, filed on Nov. 4, 2014 and published as EP 3065872 on Sep. 14, 2016.

(Continued)

*Primary Examiner* — Jan Ludlow
(74) *Attorney, Agent, or Firm* — Grant IP, Inc.

(57) ABSTRACT

Provided herein are pipette tip racks, and in particular, pipette tip rack plates that restrict lateral displacement of pipette tips loaded therein.

20 Claims, 11 Drawing Sheets

(56) References Cited

U.S. PATENT DOCUMENTS

2010/0258578 A1 10/2010 Motadel

OTHER PUBLICATIONS

International Search Report and Written Opinion dated Jan. 21, 2015 in International Application No. PCT/US14/063938, published as WO 2015/069664 on May 14, 2015.
International Preliminary Report on Patentability dated May 10, 2016 in International Application No. PCT/US14/063938, published as WO 2015/069664 on May 14, 2015.

* cited by examiner

PIPETTE TIP RACK PLATES

RELATED PATENT APPLICATIONS

This patent application is a 35 U.S.C. 371 national phase patent application of PCT/US2014/063938, filed on Nov. 4, 2014, entitled PIPETTE TIP RACK PLATES, naming Arta Motadel and Peter Paul Blaszcak as inventors, which claims the benefit of U.S. provisional application No. 61/900,312, filed on Nov. 5, 2013, entitled PIPETTE TIP RACK PLATES, naming Arta Motadel and Peter Paul Blaszcak as inventors. The entire content of this provisional patent application is incorporated herein by reference, including all text, tables and drawings.

FIELD

The technology relates in part to pipette tip racks, and in particular, plates of pipette tip racks that restrict lateral displacement of pipette tips loaded therein.

BACKGROUND

Pipette tips are utilized in a variety of industries that have a requirement for handling fluids, and are used in facilities including medical laboratories and research laboratories, for example. In many instances pipette tips are used in large numbers, and often are utilized for processing many samples and/or adding many reagents to samples.

Pipette tips often are substantially cone-shaped with an aperture at one end that can engage a dispensing device, and another relatively smaller aperture at the other end that can receive and emit fluid. Pipette tips generally are manufactured from a moldable plastic, such as polypropylene, for example. Pipette tips are made in a number of sizes to allow for accurate and reproducible liquid handling for volumes ranging from nanoliters to milliliters.

Pipette tips can be utilized in conjunction with a variety of dispensing devices, including manual dispensers (e.g., pipettors) and automated dispensers. A dispenser is a device that, when attached to the upper end of a pipette tip (the larger opening end), applies negative pressure to acquire fluids, and applies positive pressure to dispense fluids. The lower or distal portion of a dispenser (typically referred to as the barrel or nozzle) is placed in contact with the upper end of the pipette tip and held in place by pressing the barrel or nozzle of the dispenser into the upper end of the pipette tip. The combination then can be used to manipulate liquid samples.

Pipette tips often are shipped, stored and presented to a user or dispenser in racks. A tray often includes a lid, rack body and a rack plate affixed to the rack body. The pipette tip rack plate, or rack top, generally includes multiple channels through which pipette tips are inserted partially.

SUMMARY

Provided herein in certain aspects is a pipette tip rack plate that includes a plate proximal surface, a plate distal surface, multiple sleeves projecting from the plate distal surface, multiple channels and one or more projections in the channels, where: (i) each of the channels terminates at the plate proximal surface and the plate distal surface and is concentric with each of the sleeves: (ii) each of which channels comprises a first interior wall defining a bore, a second interior wall defining a counter-bore, and a rim at the junction between the bore and the counter-bore, which rim is parallel with or substantially parallel with the plate proximal surface; (iii) the one or more projections project from the first interior wall; (iv) the minimum diameter, or minimum effective diameter, of the one or more projections in the channel is about zero inches to about 0.005 inches greater than the external diameter, or external effective diameter, of a portion of a pipette tip opposing the one or more projections, which pipette tip optionally is seated in the channel; and (v) the minimum diameter, or minimum effective diameter, of the counter-bore is zero to about 0.005 inches greater than the diameter, or effective diameter, of a portion of a pipette tip opposing the second interior wall, which pipette tip optionally is seated in the channel. Other aspects and certain embodiments are described further in the following description, examples, claims and drawings.

BRIEF DESCRIPTION OF THE DRAWINGS

The drawings illustrate embodiments of the technology and are not limiting. For clarity and ease of illustration, the drawings are not made to scale and, in some instances, various aspects may be shown exaggerated or enlarged to facilitate an understanding of particular embodiments.

Figure 1:
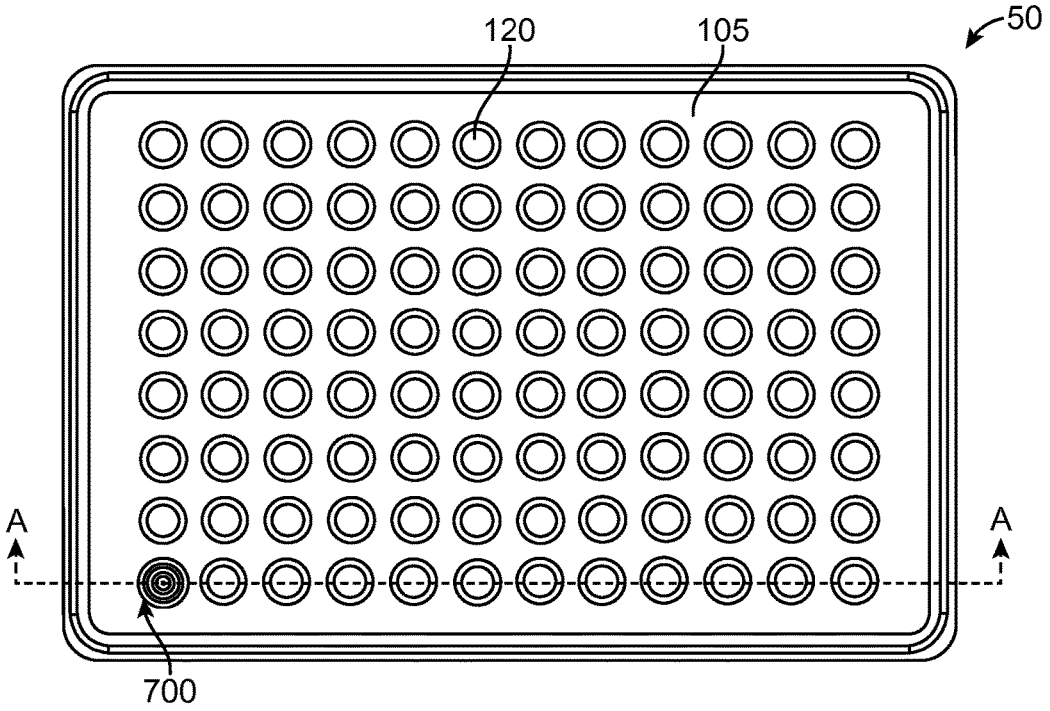
FIG. 1 shows a top view (i.e., proximal view) of a pipette tip rack embodiment.
Figure 2:
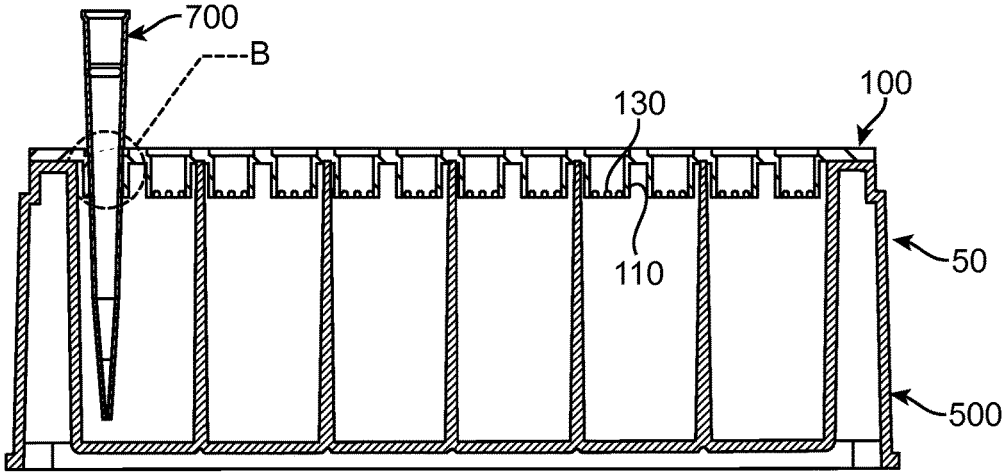
FIG. 2 shows a cross sectional view of a pipette tip rack embodiment through section A-A shown in FIG. 1.

Certain features in the drawings are summarized in the table hereafter.

| Callout | Feature |
|---|---|
| 50 | pipette tip rack |
| 100 | pipette tip rack plate |
| 104 | plate edge |
| 105 | plate proximal surface |
| 107 | plate distal surface |
| 108 | long side of plate |

-continued

| Callout | Feature |
|---|---|
| 109 | short side of plate |
| 110 | sleeve |
| 120 | channel |
| 122 | first interior wall |
| 124 | second interior wall-first wall portion |
| 125 | second interior wall-second wall portion |
| 126 | rim |
| 127 | junction between rim and second interior wall |
| 130 | projection |
| 132 | projection-first surface |
| 134 | projection-second surface |
| 136 | bore |
| 138 | counter-bore |
| 150 | effective diameter of projections |
| 500 | rack body |
| 700 | pipette tip |
| 701 | distal terminus |
| 702 | proximal terminus |
| 703 | rib |
| 705 | pipette tip longitudinal axis |
| 710 | portion of pipette tip opposing a projection |
| 720 | portion of pipette tip opposing the plate second interior wall |
| 730 | pipette tip lip |
| 750 | effective diameter of portion of pipette tip opposing the plate second interior wall |
| 800 | plate without projections and second interior wall feature |
| 810 | sleeve |
| 805 | plate proximal surface |
| 807 | plate distal surface |
| 820 | channel |
| 822 | first interior wall |
| 824 | second interior wall |
| 826 | rim |
| 827 | junction between rim and second interior wall |

DETAILED DESCRIPTION

Figure 3:
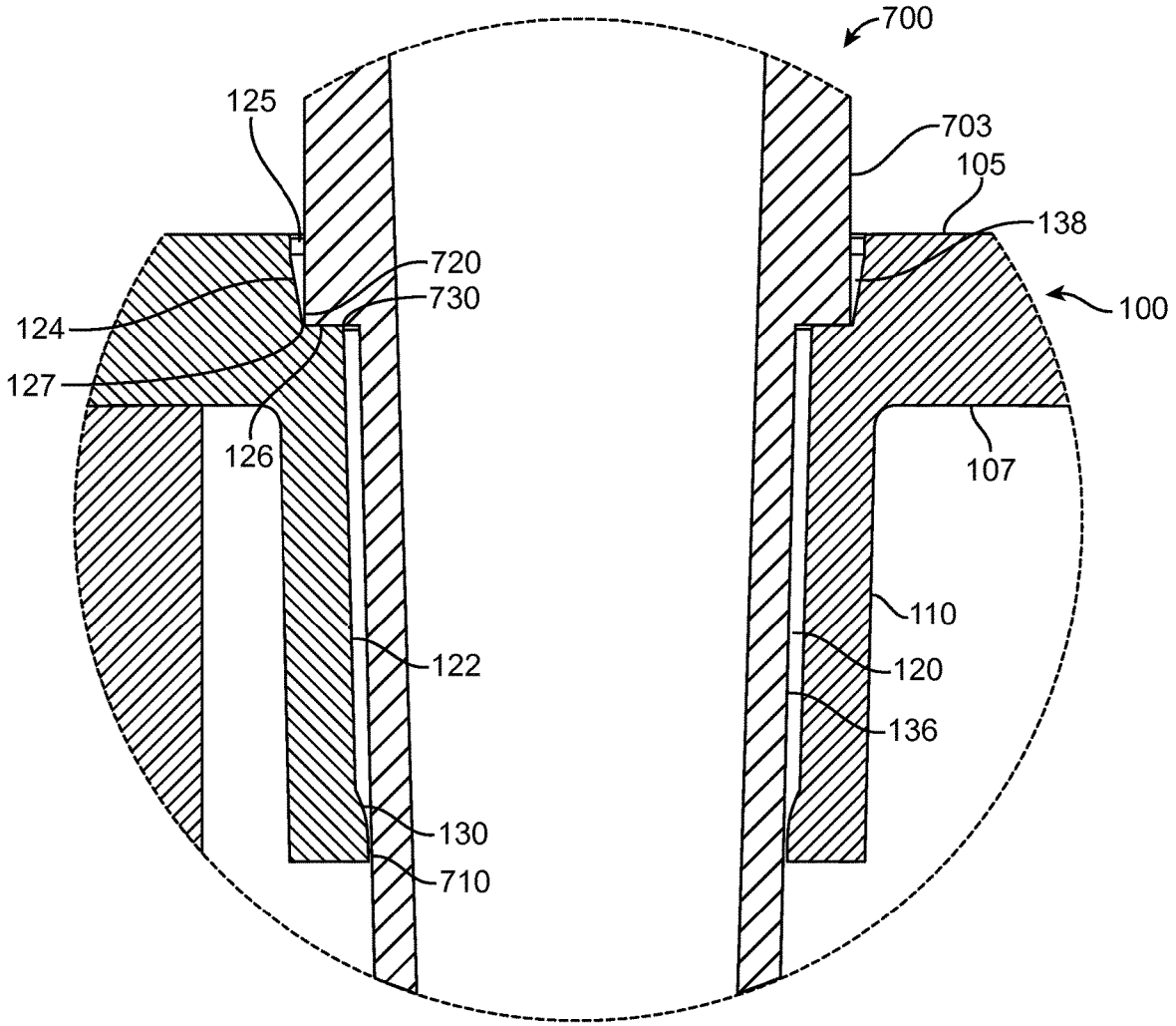
FIG. 3 shows an enlarged view of region B encircled in FIG. 2.
Figure 4:
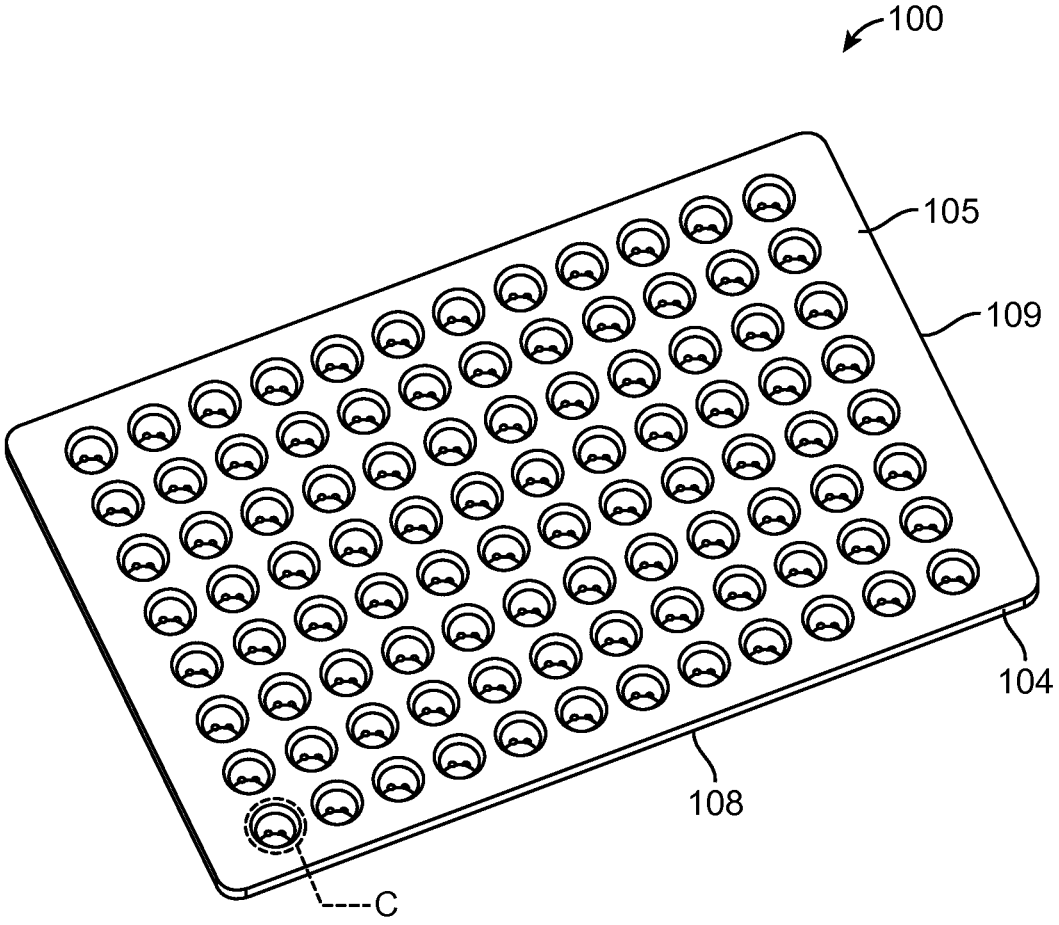
FIG. 4 shows a top perspective view (i.e., proximal perspective view) of a pipette tip rack plate embodiment.
Figure 5:
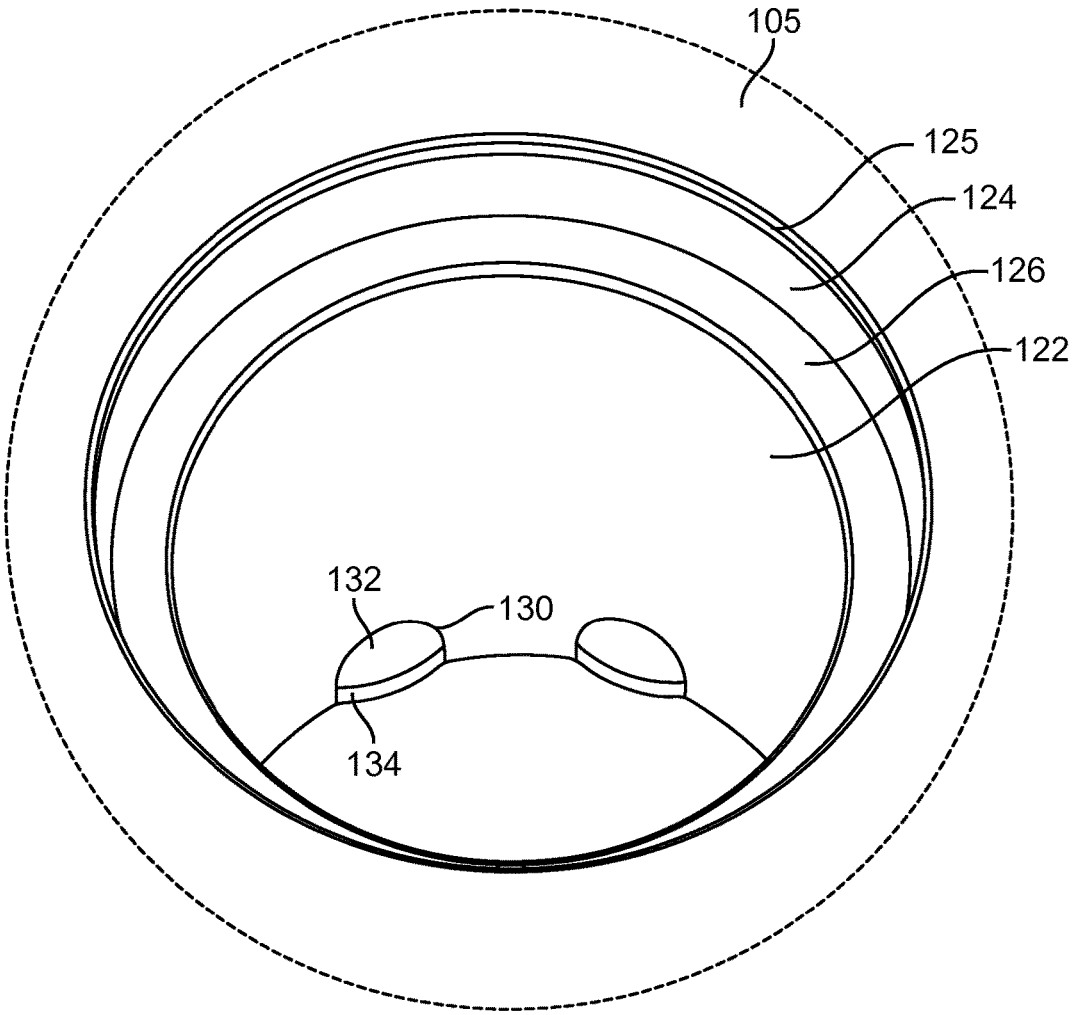
FIG. 5 shows an enlarged view of region C encircled in FIG. 4.
Figure 6:
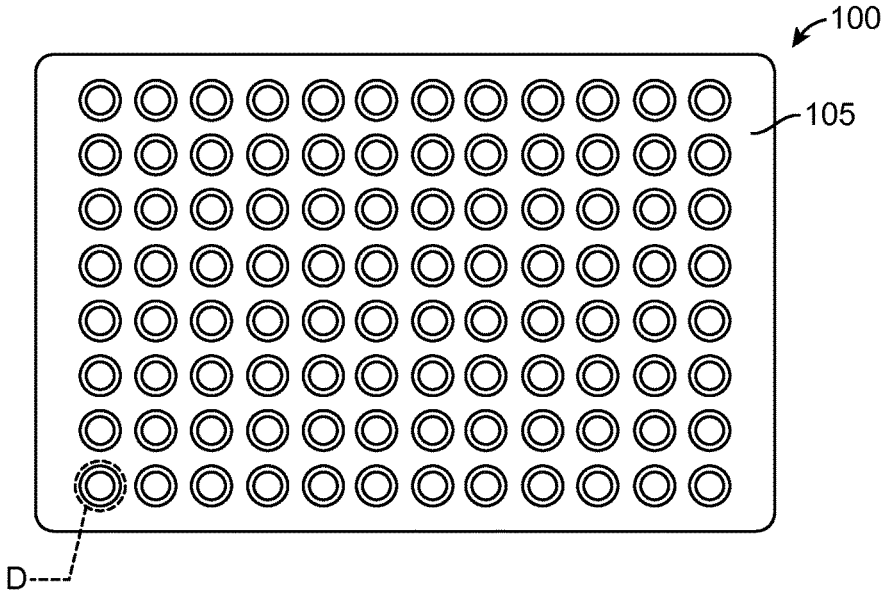
FIG. 6 shows a top view (i.e., proximal view) of a pipette tip rack plate embodiment.

Pipette tips generally are shipped in trays that include a lid, a rack body and a rack plate affixed to the rack body. A rack plate can be affixed to a rack body in any suitable manner (e.g., barb connectors (e.g., International patent application no. PCT/US2011/028881 published as WO 2011/116230 on Sep. 22, 2011), pin connectors). A rack plate generally includes multiple channels into which pipette tips can be partially inserted. A pipette tip often includes a lip (e.g., lip 730 illustrated in FIG. 3) that sometimes seats on a rim present in a channel of a rack plate (e.g., rim 126 illustrated in FIG. 3).

Figure 15:
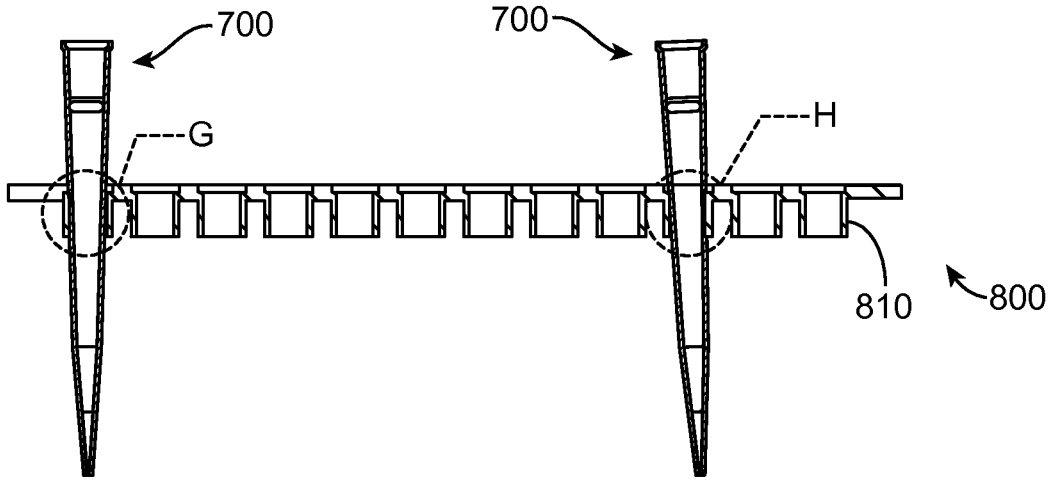
FIG. 15 is a cross sectional view of the plate shown in FIG. 14 through section F-F.
Figure 16:
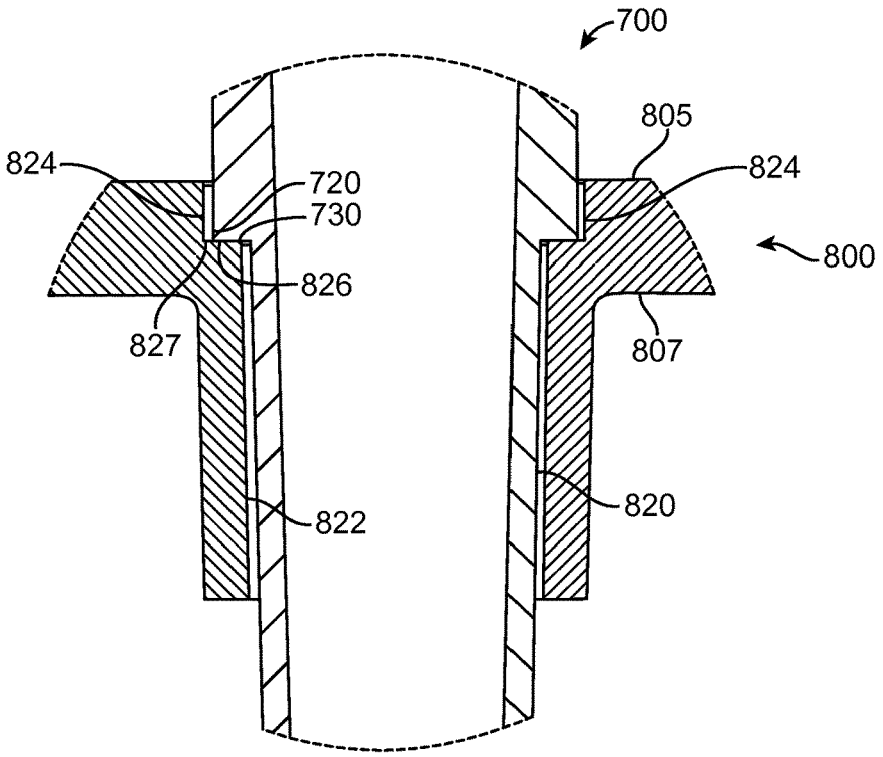
FIG. 16 is an enlarged view of encircled region G shown in FIG. 15.
Figure 17:
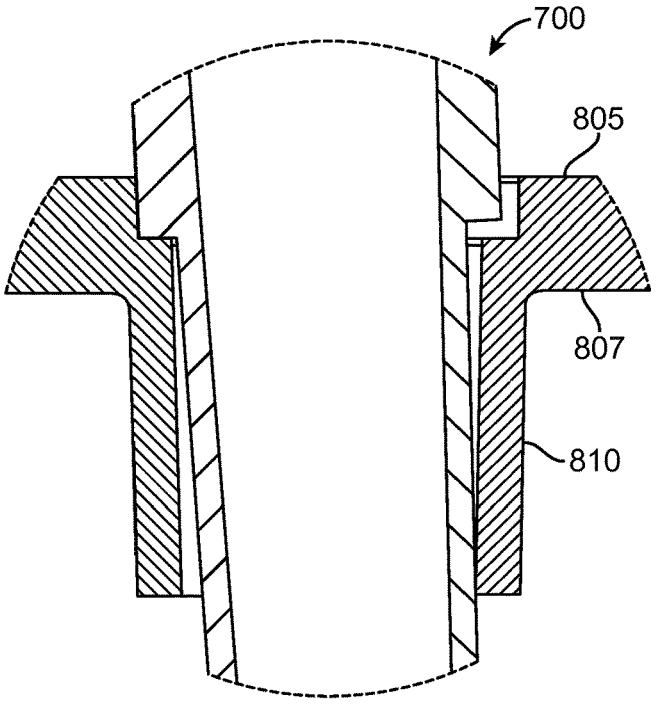
FIG. 17 is an enlarged view of encircled region H shown in FIG. 15.

During shipment and use, pipette tips can be jostled, shaken, displaced longitudinally (i.e., moved up and down) and displaced laterally (i.e., moved side to side), in the channels. This movement of the pipette tips can generate static charge that can disorient the pipette tips in the channels. Pipette tips generally are presented in a vertical orientation in a pipette tip rack, and static charge sometimes skews the pipette tips away from this vertical orientation, as static charge often attracts pipette tips to one another and to pipette tip rack sidewalls. This skew of pipette tips away from a vertical orientation is illustrated by way of example in FIG. 15 and FIG. 17. Pipette tips in an orientation that is not substantially perpendicular to the top rack plate surface is referred to herein as a "skewed orientation."

A skewed orientation of one or more pipette tips in a rack can result in inefficient uptake or extraction of pipette tips from the rack. For example, a robotic dispenser programmed to engage all pipette tips in a rack may pick up the rack along with the pipette tips when it attempts to extract pipette tips from the rack. In another example of inefficient uptake, a dispenser may not efficiently seal, and may not engage, certain pipette tips in a rack presented in a skewed orientation.

Certain features of pipette tip rack plates described herein prevent skewed presentation of pipette tips in a rack. A first feature is inclusion of one or more projections that project from a first interior wall of the channel that defines a bore, which one or more projections limit lateral displacement of a distal region of a pipette tip. The one or more projections sometimes are located at, or substantially at, the sleeve distal terminus. A channel often includes a bore and a counter-bore, which bore often is defined by a first interior surface and which counter-bore is defined by a second interior surface. This first feature may be present in a rack plate with or without the second feature described hereafter, or may not be present in a rack plate having the second feature described hereafter.

Each bore in a channel sometimes includes one projection, as for embodiments in which the projection is an annular projection that traverses a circumference of the bore. An annular projection can be of any suitable geometry, and can have a profile comprising one or more curved surfaces and/or one or more flat surfaces. An exterior surface of the annular projection furthest from the first interior wall, which projects into the interior of the bore, can define a minimum diameter of the projection.

Figure 7:
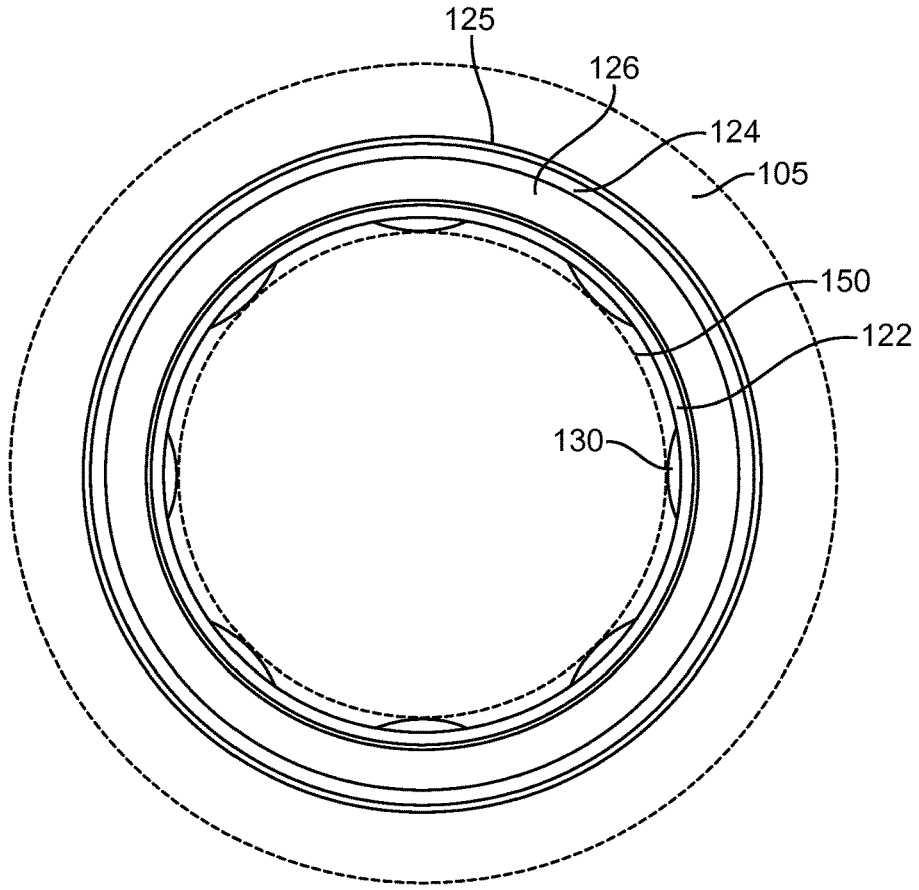
FIG. 7 shows an enlarged view of region D encircled in FIG. 6.
Figure 8:
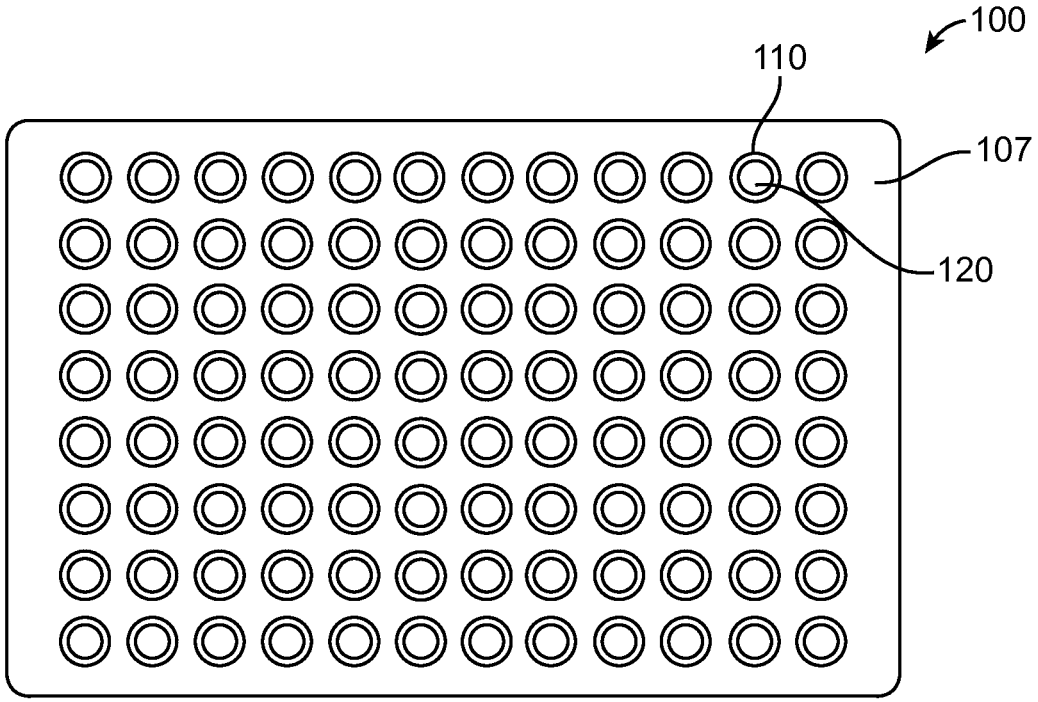
FIG. 8 shows a bottom view (i.e., distal view) of a pipette tip rack plate embodiment.
Figure 9:
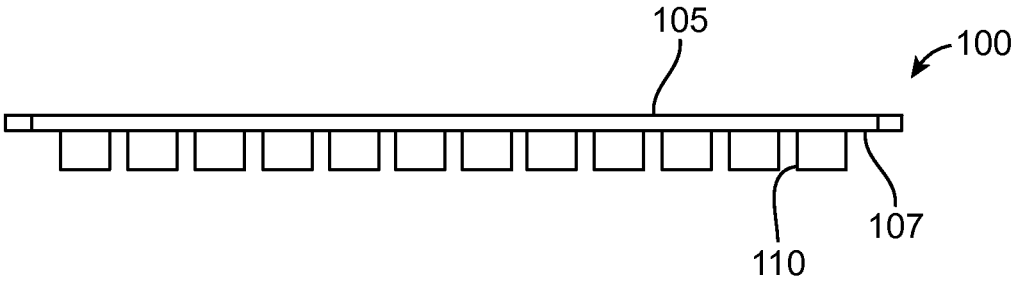
FIG. 9 shows a long side view.
Figure 10:
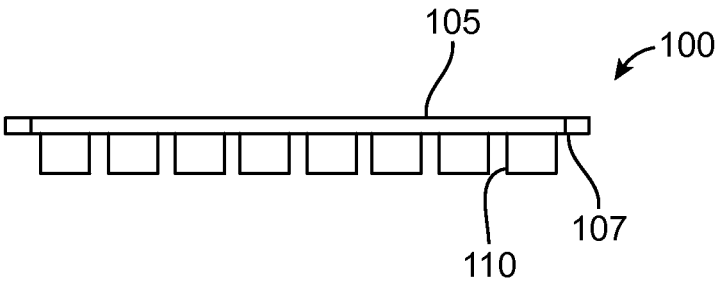
FIG. 10 shows a short side view, of a pipette tip rack plate embodiment.

At least one bore in a plate sometimes includes multiple projections (e.g., 2, 3, 4, 5, 6, 7, 8, 9, 10 projections), and the projections within each bore sometimes have the same geometry or sometimes have different geometries. Multiple projections in a channel sometimes are regularly distributed, and often equally spaced, around a circumference of the channel. Projections in a channel can have any suitable geometry. A projection in each bore, for embodiments in which at least one bore includes multiple projections, sometimes has a profile comprising one or more curved surfaces and/or one or more flat surfaces, and sometimes is generally configured as a rib (e.g., elongated structure) or nodule (e.g., non-elongated structure). For embodiments in which at least one bore includes multiple projections, the exterior surfaces of the projections furthest from the first interior wall can define a minimum effective diameter. An example of a minimum effective diameter is illustrated by 150 in FIG. 7 for multiple projections in a channel.

Figure 11:
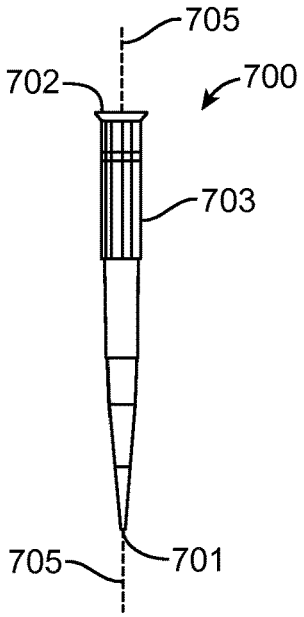
FIG. 11 shows a side view of a pipette tip embodiment.
Figure 12:
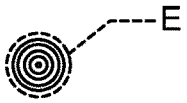
FIG. 12 shows a bottom view thereof.

A minimum diameter, or minimum effective diameter, of one or more projections in a channel often is about zero inches to about 0.005 inches greater than the external diameter, or external effective diameter, of a portion of a pipette tip opposing the one or more projections, when a pipette tip is optionally seated in the channel. A minimum diameter, or minimum effective diameter, of one or more projections in a channel sometimes is about 0.001 inches to about 0.005 inches (e.g., about 0.002 inches, about 0.003 inches, about 0.004 inches) greater than the external diameter, or external effective diameter, of a portion of a pipette tip opposing the one or more projections, when a pipette tip is optionally seated in the channel. An example of a portion of a pipette tip opposing a projection in a plate channel is illustrated by pipette tip surface portion 710 in FIG. 3. By effectively reducing the distance between the channel inner surface and a portion of a pipette tip opposing the surface, the one or more projections can limit lateral displacement of a pipette tip distal region in the channel, and allow for substantially vertical presentation of the pipette tip in a rack. Substantially vertical presentation of a pipette tip sometimes is an angle between about 87 degrees to about 93 degrees (e.g., about 88, about 89, about 90, about 91, about 92 degrees) between the longitudinal axis of a pipette tip (e.g., longitudinal axis 705 in FIG. 11) and the plate proximal surface, the latter of which generally is flat.

A second feature is configuring a rim and/or a second interior wall that defines a channel counter-bore such that it is in relatively close proximity to a proximal surface portion of a pipette tip. Restricting the minimum diameter, or minimum effective diameter, of a rim and/or a counter-bore second interior wall in a channel can reduce lateral displacement of the proximal region of a pipette tip and facilitate substantially vertical presentation of the pipette tip in the rack (when a pipette tip is seated in a channel). For embodiments in which the counter-bore second interior wall is smooth or substantially smooth, a circumference of a portion of the second interior wall closest to the pipette tip exterior surface (when a pipette tip is seated in the channel) can define a minimum diameter of the counter-bore. A second interior wall of the counter-bore can include one or more projections described above for the first interior wall. For embodiments in which the second interior wall defining the counter-bore includes one or more projections, the exterior surface of the projection(s) furthest from the second interior wall and closest to the pipette tip surface can define a minimum effective diameter (when a pipette tip is seated in the channel). This second feature may be present in a rack plate with or without the first feature or may not be present in a rack plate having the first feature.

Figure 13:
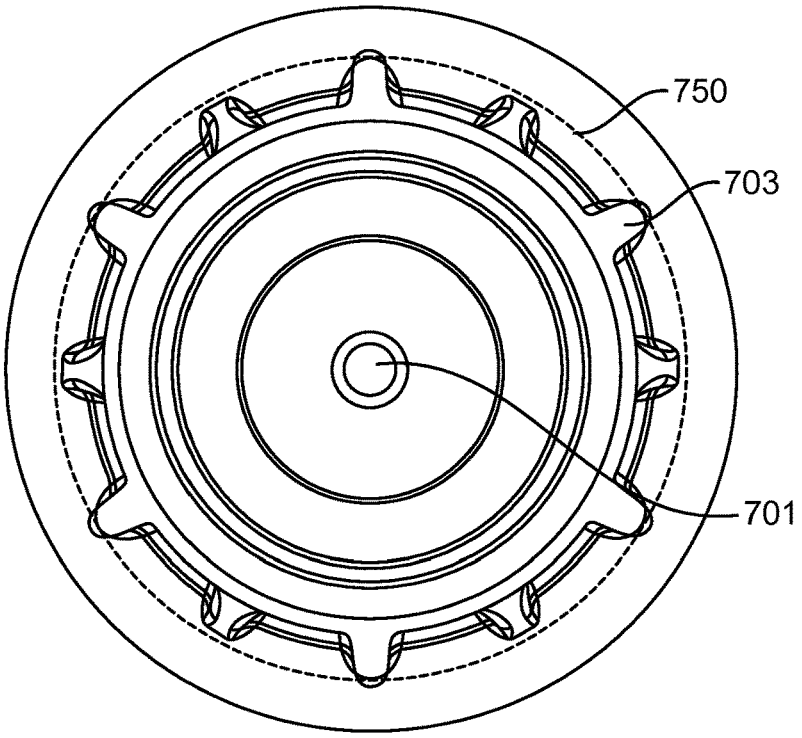
FIG. 13 shows an enlarged view of region E encircled in FIG. 12.
Figure 14:
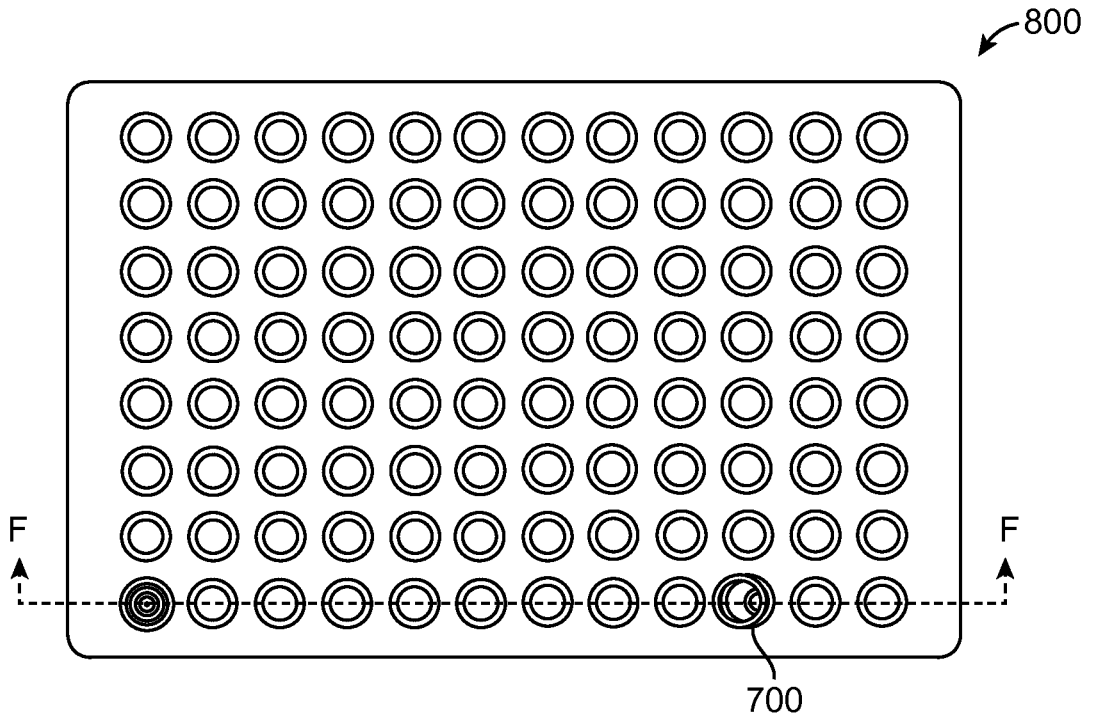
FIG. 14 shows a top view (i.e., proximal view) of pipette tip rack plate not having projections and second interior wall features present in embodiments shown in FIG. 1 to FIG. 10.

The minimum diameter, or minimum effective diameter, of the counter-bore often is zero to about 0.005 inches, and sometimes is about 0.001 inches to about 0.005 inches (e.g., about 0.001, about 0.002, about 0.003, about 0.004 inches) greater than the diameter, or effective diameter, of a portion of a pipette tip opposing the second interior wall, when a pipette tip is seated in the channel. A portion of a pipette tip opposing such a feature in a counter-bore of a channel sometimes is smooth or substantially smooth, or sometimes includes one or more ribs (e.g., rib 703 illustrated in FIG. 3). For embodiments in which a pipette tip has a smooth or substantially smooth surface in this portion, a circumference on the exterior surface of the pipette tip in this region can define a diameter. For embodiments in which a pipette tip includes one or more ribs in the portion opposing this second feature of the counter-bore, portions of the ribs extending the furthest from the pipette tip body can define an effective diameter for the portion of the pipette tip (e.g., effective diameter 750 illustrated in FIG. 13).

A counter-bore second interior wall in a channel sometimes includes a first wall portion that is not perpendicular to the rim surface and/or the proximal plate surface. The first wall portion sometimes is at an angle of about 95 degrees to about 120 degrees to the rim surface and/or the proximal plate surface (e.g., about 96 degrees, about 97 degrees, about 98 degrees, about 99 degrees, about 100 degrees, about 102 degrees, about 105 degrees, about 110 degrees, about 115 degrees). A non-perpendicular first wall surface can facilitate pipette tip loading into, and facilitate pipette tip extraction from, a rack plate channel (e.g., by reducing or preventing binding of the pipette tip with the second interior wall).

A pipette tip rack plate provided herein can be manufactured using any suitable process. A rack plate often comprises a polymer and sometimes is manufactured from one or more polymers by a molding process. Non-limiting examples of polymers that can be utilized to manufacture a rack plate include polypropylene, polyethylene, high-density polyethylene, low-density polyethylene, polyethylene teraphthalate, polyvinyl chloride, polytetrafluoroethylene, polystyrene, high-density, acrylnitrile butadiene styrene, crosslinked polysiloxane, polyurethane, (meth)acrylate-based polymer, cellulose, cellulose derivative, polycarbonate, tetrafluoroethylene polymer, the like or combination thereof.

Examples of Embodiments

Provided hereafter are certain embodiments that do not limit the technology.

A1. A pipette tip rack plate, comprising:

a plate proximal surface, a plate distal surface, multiple sleeves projecting from the plate distal surface, multiple channels and one or more projections in the channels, wherein:

each of the channels terminates at the plate proximal surface and the plate distal surface and is concentric with each of the sleeves;

each of which channels comprises a first interior wall defining a bore, a second interior wall defining a counter-bore, and a rim at the junction between the bore and the counter-bore, which rim is parallel with or substantially parallel with the plate proximal surface;

the one or more projections project from the first interior wall;

the minimum diameter, or minimum effective diameter, of the one or more projections in the channel is about 0.001 inches to about 0.005 inches greater than the external diameter, or external effective diameter, of a portion of a pipette tip opposing the one or more projections, which pipette tip optionally is seated in the channel; and the minimum diameter, or minimum effective diameter, of the counter-bore is zero to about 0.005 inches greater than the diameter, or effective diameter, of a portion of a pipette tip opposing the second interior wall, which pipette tip optionally is seated in the channel.

A2. The pipette tip rack plate of embodiment A1, wherein the second interior wall comprises a first wall portion joining at the rim that is not perpendicular to the rim surface.

A3. The pipette tip rack plate of embodiment A2, wherein the first wall portion is at an angle of about 95 degrees to about 120 degrees to the pipette tip seating surface.

A4. The pipette tip rack plate of embodiment A2 or A3, wherein the second interior wall comprises a second wall portion proximal to the first wall portion that is perpendicular or substantially perpendicular to the plate proximal surface.

A5. The pipette tip rack plate of any one of embodiments A1 to A4, wherein each counter-bore is proximal to each bore in each of the channels.

A6. The pipette tip rack plate of any one of embodiments A1 to A5, wherein each of the projections comprises a flat surface, a curved surface or a flat surface and a curved surface.

A7. The pipette tip rack plate of any one of embodiments A1 to A6, wherein at least one of the one or more projections in a channel is a rib or a nodule.

A8. The pipette tip rack plate of any one of embodiments A1 to A7, which comprises a polymer.

A9. The pipette tip rack plate of embodiment A8, which is manufactured from a polymer.

A10. The pipette tip rack plate of any one of embodiments A1 to A9, in connection with a rack body.

A11. The pipette tip rack plate of any one of embodiments A1 to A10, which comprises a pipette tip seated in one or more or all channels.

A12. The pipette tip rack of embodiment A11, wherein the lateral displacement of each pipette tip is limited by (i) the diameter or effective diameter of the projections and (ii) the minimum diameter or effective minimum diameter of the counter-bore.

B1. A process for manufacturing a pipette tip rack plate, comprising:

flowing a polymer into a mold comprising interior surfaces configured to shape the pipette tip rack plate of any one of embodiments A1 to A9, ejecting the plate after the polymer has solidified or partially solidified.

B2. A process for manufacturing a pipette tip rack, comprising joining a pipette tip rack plate of any one of embodiments A1 to A9 to a rack body.

B3. A process for manufacturing a pipette tip rack, comprising loading pipette tips into a pipette tip rack comprising a pipette tip rack plate of any one of embodiments A1 to A9.

The entirety of each patent, patent application, publication and document referenced herein hereby is incorporated by reference. Citation of the above patents, patent applications, publications and documents is not an admission that any of the foregoing is pertinent prior art, nor does it constitute any admission as to the contents or date of these publications or documents.

Modifications may be made to the foregoing without departing from the basic aspects of the technology. Although the technology has been described in substantial detail with reference to one or more specific embodiments, those of ordinary skill in the art will recognize that changes may be made to the embodiments specifically disclosed in this application, yet these modifications and improvements are within the scope and spirit of the technology.

The technology illustratively described herein suitably may be practiced in the absence of any element(s) not specifically disclosed herein. Thus, for example, in each instance herein any of the terms "comprising," "consisting essentially of," and "consisting of" may be replaced with either of the other two terms. The terms and expressions which have been employed are used as terms of description and not of limitation, and use of such terms and expressions do not exclude any equivalents of the features shown and described or portions thereof, and various modifications are possible within the scope of the technology claimed. The term "a" or "an" can refer to one of or a plurality of the elements it modifies (e.g., "a reagent" can mean one or more reagents) unless it is contextually clear either one of the elements or more than one of the elements is described. The term "about" as used herein refers to a value within 10% of the underlying parameter (i.e., plus or minus 10%), and use of the term "about" at the beginning of a string of values modifies each of the values (i.e., "about 1, 2 and 3" refers to about 1, about 2 and about 3). For example, a weight of "about 100 grams" can include weights between 90 grams and 110 grams. Further, when a listing of values is described herein (e.g., about 50%, 60%, 70%, 80%, 85% or 86%) the listing includes all intermediate and fractional values thereof (e.g., 54%, 85.4%). Thus, it should be understood that although the present technology has been specifically disclosed by representative embodiments and optional features, modification and variation of the concepts herein disclosed may be resorted to by those skilled in the art, and such modifications and variations are considered within the scope of this technology.

Certain embodiments of the technology are set forth in the claim(s) that follow(s).

What is claimed is:

1. A pipette tip rack plate, comprising:

a plate proximal surface, a plate distal surface, multiple sleeves projecting from the plate distal surface, multiple channels and one or more projections in the channels, wherein:

each channel terminates at the plate proximal surface and at the plate distal surface is concentric with a sleeve;

each of which channels comprises a first interior wall defining a bore, a second interior wall defining a counter-bore, and a rim at the junction between the bore and the counter-bore, which rim is parallel with or substantially parallel with the plate proximal surface and is between the plate proximal surface and the plate distal surface;

the one or more projections project from the first interior wall are located at or substantially at a sleeve distal terminus and have a minimum diameter or minimum effective diameter; and the second interior wall defines a minimum diameter or minimum effective diameter of the counter-bore.

2. The pipette tip rack plate of claim 1, wherein the second interior wall comprises a first wall portion joining at the rim that is not perpendicular to the rim surface.

3. The pipette tip rack plate of claim 2, wherein the first wall portion is at an angle of about 95 degrees to about 120 degrees to the rim.

4. The pipette tip rack plate of claim 2, wherein the second interior wall comprises a second wall portion proximal to the first wall portion that is perpendicular or substantially perpendicular to the plate proximal surface.

5. The pipette tip rack plate of claim 1, wherein each counter-bore is proximal to each bore in each of the channels.

6. The pipette tip rack plate of claim 1, wherein each of the projections comprises a flat surface, a curved surface or a flat surface and a curved surface.

7. The pipette tip rack plate of claim 1, wherein at least one of the one or more projections in a channel is a rib or a nodule.

8. The pipette tip rack plate of claim 1, which comprises a polymer.

9. The pipette tip rack plate of claim 8, which is manufactured from a polymer.

10. The pipette tip rack plate of claim 8, wherein the polymer is selected from the group consisting of: polypropylene, polyethylene, high-density polyethylene, low-density polyethylene, polyethylene teraphthalate, polyvinyl chloride, polytetrafluoroethylene, polystyrene, high-density, acrylnitrile butadiene styrene, crosslinked polysiloxane, polyurethane, (meth)acrylate-based polymer, cellulose, cellulose derivative, polycarbonate, and tetrafluoroethylene polymer.

11. The pipette tip rack plate of claim 1, further comprising a rack body.

12. The pipette tip rack plate of claim 11, further comprising a lid.

13. The pipette tip rack plate of claim 1, which comprises one or more pipette tips seated in one or more of the channels.

14. The pipette tip rack of claim 13, wherein the lateral displacement of each pipette tip is limited by (i) the diameter or effective diameter of the projections and (ii) the minimum diameter or effective minimum diameter of the counter-bore.

15. The pipette tip rack plate of claim 13, wherein a portion of the pipette tip or pipette tips opposing the counterbore of a channel is substantially smooth or includes one or more ribs.

16. A process for manufacturing a pipette tip rack plate, comprising:

flowing a polymer into a mold comprising interior surfaces configured to shape the pipette tip rack plate of claim 1, ejecting the plate after the polymer has solidified or partially solidified.

17. The process of claim 16, wherein the polymer is selected from the group consisting of: polypropylene, polyethylene, high-density polyethylene, low-density polyethylene, polyethylene teraphthalate, polyvinyl chloride, polytetrafluoroethylene, polystyrene, high-density, acrylnitrile butadiene styrene, crosslinked polysiloxane, polyurethane, (meth)acrylate-based polymer, cellulose, cellulose derivative, polycarbonate, and tetrafluoroethylene polymer.

18. A process for manufacturing a pipette tip rack, comprising joining a pipette tip rack plate of claim 1 to a rack body.

19. The process of claim 18, wherein the pipette tip rack comprises a polymer selected from the group consisting of: polypropylene, polyethylene, high-density polyethylene, low-density polyethylene, polyethylene teraphthalate, polyvinyl chloride, polytetrafluoroethylene, polystyrene, high-density, acrylnitrile butadiene styrene, crosslinked polysiloxane, polyurethane, (meth)acrylate-based polymer, cellulose, cellulose derivative, polycarbonate, and tetrafluoroethylene polymer.

20. A process for manufacturing a pipette tip rack, comprising loading pipette tips into a pipette tip rack comprising a pipette tip rack plate of claim 1.

* * * * *